US007893882B2

(12) United States Patent
Shtrom

(10) Patent No.: US 7,893,882 B2
(45) Date of Patent: Feb. 22, 2011

(54) PATTERN SHAPING OF RF EMISSION PATTERNS

(75) Inventor: Victor Shtrom, Sunnyvale, CA (US)

(73) Assignee: Ruckus Wireless, Inc., Sunnyvale, CA (US)

( * ) Notice: Subject to any disclaimer, the term of this patent is extended or adjusted under 35 U.S.C. 154(b) by 558 days.

(21) Appl. No.: 11/971,210

(22) Filed: Jan. 8, 2008

(65) Prior Publication Data

US 2008/0204331 A1 Aug. 28, 2008

Related U.S. Application Data

(60) Provisional application No. 60/883,962, filed on Jan. 8, 2007.

(51) Int. Cl.
*H01Q 1/24* (2006.01)

(52) U.S. Cl. ..... 343/702

(58) Field of Classification Search ..... 343/702, 343/700 MS, 876, 767, 770–771
See application file for complete search history.

(56) References Cited

U.S. PATENT DOCUMENTS

| | | | | |
|---|---|---|---|---|
| 3,568,105 | A | 3/1971 | Felsenheld | |
| 3,887,925 | A | 6/1975 | Ranghelli | |
| 3,982,214 | A | 9/1976 | Burns | |
| 4,001,734 | A | 1/1977 | Burns | |
| 4,027,307 | A | 5/1977 | Litchford | |
| 4,203,118 | A * | 5/1980 | Alford | 343/727 |
| 4,253,193 | A | 2/1981 | Kennard | |
| 4,513,412 | A | 4/1985 | Cox | |
| 4,554,554 | A | 11/1985 | Olesen et al. | |
| 4,821,040 | A * | 4/1989 | Johnson et al. | 343/700 MS |
| 5,097,484 | A | 3/1992 | Akaiwa | |
| 5,203,010 | A | 4/1993 | Felix | |
| 5,208,564 | A | 5/1993 | Burns et al. | |
| 5,373,548 | A | 12/1994 | McCarthy | |
| 5,434,575 | A | 7/1995 | Jelinek | |
| 5,479,176 | A | 12/1995 | Zavrel | |
| 5,507,035 | A | 4/1996 | Bantz | |
| 5,532,708 | A | 7/1996 | Krenz et al. | |
| 5,726,666 | A * | 3/1998 | Hoover et al. | 343/770 |
| 5,754,145 | A | 5/1998 | Evans | |
| 5,767,755 | A | 6/1998 | Kim et al. | |
| 5,767,807 | A | 6/1998 | Pritchett | |

(Continued)

FOREIGN PATENT DOCUMENTS

DE 102006026350 A1 12/2006

(Continued)

OTHER PUBLICATIONS

Chuang et al., A 2.4 GHz Polarization-diversity Planar Printed Dipole Antenna for WLAN and Wireless Communication Applications, Microwave Journal, vol. 45, No. 6, pp. 50-62 (Jun. 2002).

(Continued)

*Primary Examiner*—Huedung Mancuso
(74) *Attorney, Agent, or Firm*—Carr & Ferrell LLP

(57) ABSTRACT

A metallic shaping plate located in the interior housing of a wireless device is disclosed. The metallic shaping plate may influence a radiation pattern being generated by a horizontal antenna array. The result may be an increase in the gain of the array.

12 Claims, 7 Drawing Sheets

U.S. PATENT DOCUMENTS

| | | | | |
|---|---|---|---|---|
| 5,786,793 | A | 7/1998 | Maeda et al. | |
| 5,828,346 | A | 10/1998 | Park | |
| 5,936,595 | A | 8/1999 | Wang | |
| 5,990,838 | A | 11/1999 | Burns et al. | |
| 6,005,525 | A | 12/1999 | Kivela | |
| 6,011,450 | A | 1/2000 | Miya | |
| 6,031,503 | A | 2/2000 | Preiss, II et al. | |
| 6,052,093 | A | 4/2000 | Yao et al. | |
| 6,091,364 | A | 7/2000 | Murakami et al. | |
| 6,097,347 | A | 8/2000 | Duan et al. | |
| 6,104,356 | A | 8/2000 | Hikuma et al. | |
| 6,169,523 | B1 | 1/2001 | Ploussios | |
| 6,288,682 | B1 | 9/2001 | Thiel | |
| 6,323,810 | B1 | 11/2001 | Poilasne et al. | |
| 6,339,404 | B1 | 1/2002 | Johnson et al. | |
| 6,414,647 | B1 | 7/2002 | Lee | |
| 6,424,311 | B1 | 7/2002 | Tsai et al. | |
| 6,456,242 | B1 | 9/2002 | Crawford | |
| 6,521,422 | B1 | 2/2003 | Hsu | |
| 6,531,985 | B1 | 3/2003 | Jones et al. | |
| 6,583,765 | B1 | 6/2003 | Schamberger et al. | |
| 6,606,059 | B1 | 8/2003 | Barabash | |
| 6,611,230 | B2 | 8/2003 | Phelan | |
| 6,621,029 | B2 | 9/2003 | Galmiche | |
| 6,642,889 | B1 | 11/2003 | McGrath | |
| 6,642,890 | B1 * | 11/2003 | Chen | 343/700 MS |
| 6,724,346 | B2 | 4/2004 | Le Bolzer | |
| 6,741,219 | B2 | 5/2004 | Shor | |
| 6,747,605 | B2 | 6/2004 | Lebaric | |
| 6,757,267 | B1 | 6/2004 | Evans | |
| 6,839,038 | B2 | 1/2005 | Weinstein | |
| 6,859,176 | B2 | 2/2005 | Choi | |
| 6,859,182 | B2 | 2/2005 | Horii | |
| 6,876,836 | B2 | 4/2005 | Lin et al. | |
| 6,888,504 | B2 | 5/2005 | Chiang | |
| 6,894,653 | B2 | 5/2005 | Chiang | |
| 6,903,686 | B2 | 6/2005 | Vance et al. | |
| 6,914,581 | B1 | 7/2005 | Popek | |
| 6,943,749 | B2 | 9/2005 | Paun | |
| 6,950,069 | B2 | 9/2005 | Gaucher et al. | |
| 6,965,353 | B2 | 11/2005 | Shirosaka et al. | |
| 6,980,782 | B1 | 12/2005 | Braun et al. | |
| 7,023,909 | B1 | 4/2006 | Adams et al. | |
| 7,034,769 | B2 | 4/2006 | Surducan et al. | |
| 7,053,844 | B2 | 5/2006 | Gaucher et al. | |
| 7,088,299 | B2 | 8/2006 | Siegler et al. | |
| D530,325 | S | 10/2006 | Kerila | |
| 7,164,380 | B2 | 1/2007 | Saito | |
| 7,193,562 | B2 | 3/2007 | Shtrom et al. | |
| 7,277,063 | B2 | 10/2007 | Shirosaka et al. | |
| 7,298,228 | B2 | 11/2007 | Sievenpiper | |
| 7,312,762 | B2 | 12/2007 | Puente Ballarda et al. | |
| 7,319,432 | B2 | 1/2008 | Andersson | |
| 7,385,563 | B2 * | 6/2008 | Bishop | 343/844 |
| 7,522,569 | B2 | 4/2009 | Rada | |
| 7,697,550 | B2 | 4/2010 | Rada | |
| 2001/0046848 | A1 | 11/2001 | Kenkel | |
| 2002/0084942 | A1 | 7/2002 | Tsai | |
| 2002/0101377 | A1 | 8/2002 | Crawford | |
| 2004/0145528 | A1 | 7/2004 | Mukai et al. | |
| 2004/0160376 | A1 | 8/2004 | Hornsby et al. | |
| 2004/0227669 | A1 | 11/2004 | Okado | |
| 2005/0048934 | A1 | 3/2005 | Rawnick et al. | |
| 2005/0146475 | A1 | 7/2005 | Bettner et al. | |
| 2006/0262015 | A1 | 11/2006 | Thornell-Pers et al. | |
| 2008/0062058 | A1 * | 3/2008 | Bishop | 343/835 |
| 2009/0315794 | A1 * | 12/2009 | Alamouti et al. | 343/753 |

FOREIGN PATENT DOCUMENTS

| | | | |
|---|---|---|---|
| EP | 352787 | A2 | 1/1990 |
| EP | 0756381 | A2 | 1/1997 |
| EP | 0883206 | A2 | 5/1998 |
| EP | 1152542 | A1 | 11/2001 |
| GB | 2426870 | A | 6/2006 |
| GB | 2423191 | A | 8/2006 |
| JP | 03038933 | | 2/1991 |
| WO | 9955012 | A2 | 10/1999 |
| WO | WO2004051798 | | 6/2004 |

OTHER PUBLICATIONS

Frederick et al., Smart Antennas Based on Spatial Multiplexing of Local Elements (SMILE) for Mutual Coupling Reduction, IEEE Transactions of Antennas and Propogation, vol. 52., No. 1, pp. 106-114 (Jan. 2004).

W.E. Doherty, Jr. et al., The Pin Diode Circuit Designer'S Handbook (1998).

Varnes et al., A Switched Radial Divider for an L-Band Mobile Satellite Antenna, European Microwave Conference (Oct. 1995), pp. 1037-1041.

English Translation of PCT Pub. No. WO2004/051798 (as filed U.S. Appl. No. 10/536,547) (Dec. 2, 2002).

Behdad et al., Slot Antenna Miniaturization Using Distributed Inductive Loading, Antenna and Propagation Society International Symposium, 2003 IEEE, vol. 1, pp. 308-311 (Jun. 2003).

Press Release, Netgear RangeMax(TM) Wireless Networking Solutions Incorporate Smart MIMO Technology To Eliminate Wireless Dead Spots and Take Consumers Farther, Ruckus Wireles Inc. (Mar. 7, 2005), available at http://ruckuswireless.com/press/releases/20050307.php.

Tsunekawa, Kouichi, "Diversity Antennas for Portable Telephones," 39th IEEE Vehicular Technology Conference, pp. 50-56, vol. I, Gateway to New Concepts in Vehicular Technology, May 1-3, 1989, San Francisco, CA.

Supplementary European Search Report for foreign application No. EP07755519 dated Mar. 11, 2009.

Ando et al., "Study of Dual-Polarized Omni-Directional Antennas for 5.2 GHz-Band 2×2 MIMO-OFDM Systems," Antennas and Propogation Society International Symposium, 2004, IEEE, pp. 1740-1743 vol. 2.

Bedell, Paul, "Wireless Crash Course," 2005, p. 84, The McGraw-Hill Companies, Inc., USA.

Petition Decision Denying Request to Order Additional Claims for U.S. Patent No. 7,193,562 (Control No. 95/001078) mailed on Jul. 10, 2009.

Right of Appeal Notice for U.S. Patent No. 7,193,562 (Control No. 95/001078) mailed on Jul. 10, 2009.

Supplementary European Search Report mailed Jul. 21, 2009 in European patent application No. 05 776697.4-1248.

ORINOCO AP-2000 5GHz Kit, "Access Point Family," Proxim Wireless Corporation, (2003).

* cited by examiner

PATTERN SHAPING OF RF EMISSION PATTERNS

CROSS-REFERENCE TO RELATED APPLICATIONS

The present application claims the priority benefit of U.S. provisional patent application No. 60/883,962 filed Jan. 8, 2007 and entitled "Pattern Shaping of RF Emission Patterns," the disclosure of which incorporated herein by reference.

The present application is related to U.S. patent application Ser. No. 11/938,240 filed Nov. 9, 2007 and entitled "Multiple-Input Multiple-Output Wireless Antennas" and U.S. patent application Ser. No. 11/041,145 filed Jan. 21, 2005 and entitled "System and Method for a Minimized Antenna Apparatus with Selectable Elements." The disclosure of each of the aforementioned applications is incorporated herein by reference.

FIELD OF THE INVENTION

The present invention generally relates to wireless communications and more particularly to changing radio frequency (RF) emission patterns with respect to one or more antenna arrays.

DESCRIPTION OF THE RELATED ART

In wireless communications systems, there is an ever-increasing demand for higher data throughput and a corresponding drive to reduce interference that can disrupt data communications. For example, a wireless link in an Institute of Electrical and Electronic Engineers (IEEE) 802.11 network may be susceptible to interference from other access points and stations, other radio transmitting devices, and changes or disturbances in the wireless link environment between an access point and remote receiving node. In some instances, the interference may degrade the wireless link thereby forcing communication at a lower data rate. The interference may, however, be sufficiently strong as to disrupt the wireless link altogether.

One solution is to utilize a diversity antenna scheme. In such a solution, a data source is coupled to two or more physically separated omnidirectional antennas. An access point may select one of the omnidirectional antennas by which to maintain a wireless link. Because of the separation between the omnidirectional antennas, each antenna experiences a different signal environment and corresponding interference level with respect to the wireless link. A switching network couples the data source to whichever of the omnidirectional antennas experiences the least interference in the wireless link.

Notwithstanding, many high-gain antenna environments still encounter—or cause—electromagnetic interference (EMI). This interference may be encountered (or created) with respect to another nearby wireless environments (e.g., between the floors of an office building or hot spots scattered amongst a single room). In some instances, the mere operation of a power supply or electronic equipment—not necessarily an antenna—can create electromagnetic interference.

One solution to combat electromagnetic interference is to utilize shielding in or proximate an antenna enclosure. Shielding a metallic enclosure is imperfect, however, because the conductivity of all metals is finite. Because metallic shields have less than infinite conductivity, part of the field is transmitted across the boundary and supports a current in the metal. The amount of current flow at any depth in the shield and the rate of decay are governed by the conductivity of the metal, its permeability, and the frequency and amplitude of the field source.

A gap or seam in a shield will allow electromagnetic fields to radiate through the shield unless the current continuity can be preserved across the gaps. An EMI gasket is, therefore, often used to preserve continuity or current flow in the shield. If a gasket is made of material identical to the walls of the shielded enclosure, the current density in the gasket will be the same. An EMI gasket fails to allow for shaping of RF patterns and gain control as the gasket is implemented to seal openings in an enclosure as to prevent transmission of EMI.

SUMMARY OF THE INVENTION

A metallic shaping plate is located in or on the interior housing of a wireless device. An antenna array located in the housing may generate a radiation pattern when elements of the array are coupled to a radio frequency feed port. The metallic shaping plate may, as a result of its proximity to the array, influence the pattern being generated by the array. The result may be an increase in the gain of the array while reducing effects of EMI.

In one claimed embodiment, a wireless device includes a horizontal antenna array, a housing enclosing the horizontal antenna array, and a metallic shaping plate.

The horizontal antenna array includes antenna elements, the selectively coupling of which to a radio frequency feed port generates a substantially omnidirectional radiation pattern having less directionality than the directional radiation pattern of a single antenna element. The substantially omnidirectional radiation pattern is substantially in the plane of the horizontal antenna array.

The metallic shaping plate is coupled to the interior of the housing and is substantially centered with respect to the central, vertical axis of the horizontal antenna array. The placement of the metallic shaping plate causes a change in the substantially omnidirectional radiation pattern generated by the horizontal antenna array.

In a second claimed embodiment, a metallic shaping plate is configured to be coupled to the interior of a housing for a horizontal antenna array. The shaping plate is further configured to be substantially centered with respect to the central, vertical axis of the horizontal antenna array. The placement of the shaping plate causes a change in a radiation pattern generated by the horizontal antenna array.

DETAILED DESCRIPTION

Figure 1:
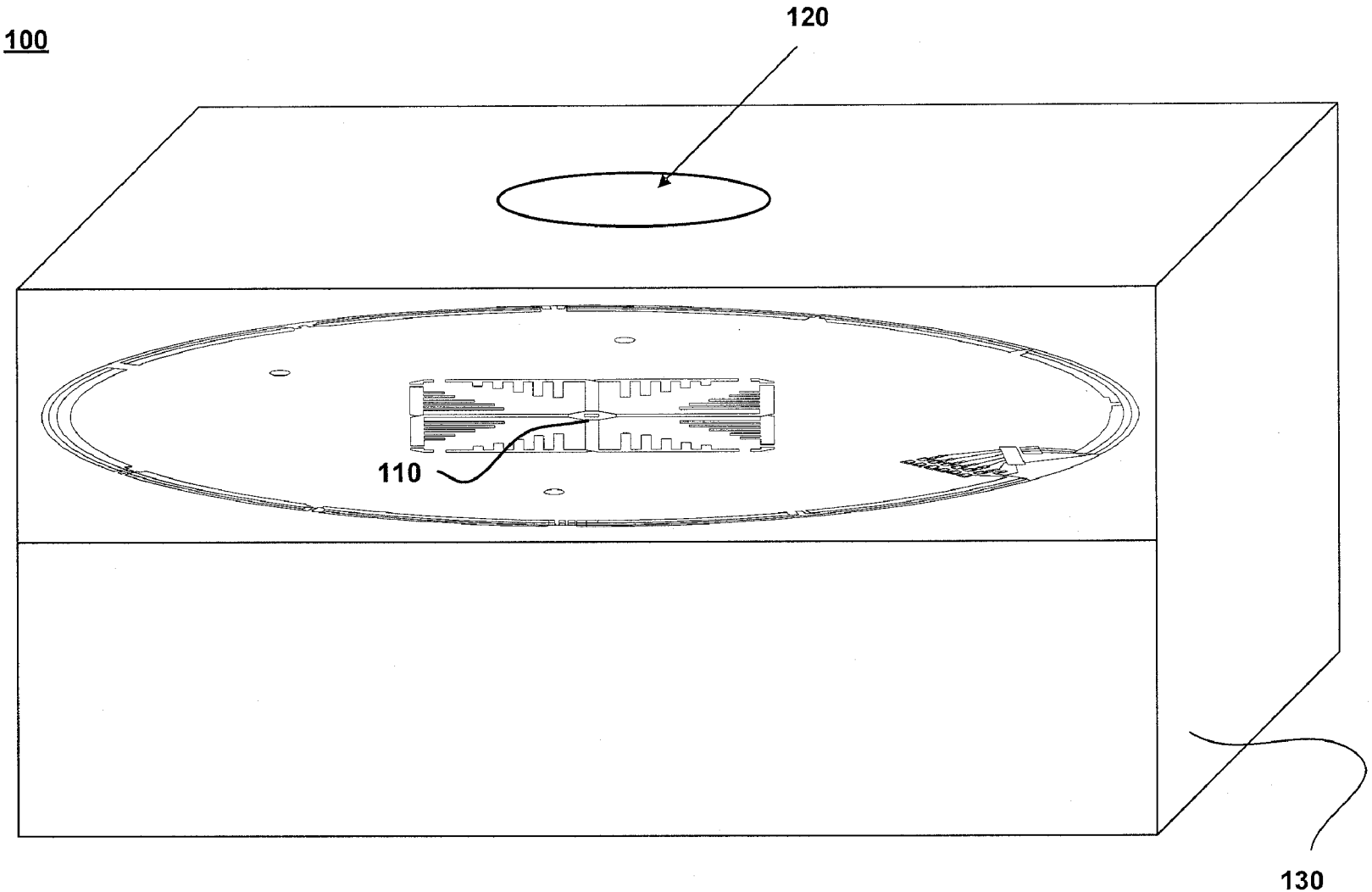
FIG. 1 illustrates a wireless device including a horizontal antenna array and a substantially circular metallic shaping plate effectuating a change in a radiation pattern emitted by the horizontal antenna array.

FIG. 1 illustrates a wireless device 100 including a horizontal antenna array 110 and a substantially circular metallic shaping plate 120 for effectuating a change in a radiation pattern emitted by the horizontal antenna array 110.

The horizontal array 110 of FIG. 1 may include a plurality of antenna elements coupled to a radio frequency feed port. Selectively coupling two or more of the antenna elements to the radio frequency feed port may generate a substantially omnidirectional radiation pattern having less directionality than the directional radiation pattern of a single antenna element. The substantially omnidirectional radiation pattern may be substantially in the plane of the horizontal antenna array.

In some embodiments, the horizontal antenna array may include multiple selectively coupled directors configured to cause a change in the substantially omnidirectional radiation pattern generated by the horizontal antenna array. In such an embodiment, the antenna elements may be permanently coupled to a radio frequency feed port. The directors, however, may be configured such that the effective length of the directors may change through selective coupling of one or more directors to one another.

For example, a series of interrupted and individual directors that are 0.1 cm in length may be selectively coupled in a manner similar to the selective coupling of the aforementioned antenna elements. By coupling together three of the aforementioned 0.1 cm directors, the directors may effectively become reflectors that reflect and otherwise shape the RF pattern emitted by the active antenna elements. RF energy emitted by an antenna array may be focused through these reflectors (and/or directors) to address particular nuances of a given wireless environment. Similar selectively coupled directors may operate with respect to a metallic shaping plate as is further discussed below.

While a horizontal antenna array (110) has been referenced, vertical or off-axis antenna arrays may also be implemented in the practice of the present invention. Likewise, multiple polarization antennas (e.g., an antenna system comprising a two horizontal and a single vertical antenna array) may be used in the practice of the present invention.

In FIG. 1, the horizontal antenna array 110 is enclosed within housing 130. The size and configuration of the housing 130 may vary depending on the exact nature of the wireless device the housing 130 encompasses. For example, the housing 130 may correspond to that of a wireless router that creates a wireless network via a broadband connection in a home or office. The housing 130 may, alternatively, correspond to a wireless access point like that of U.S. design patent application Ser. No. 29/292,091. The physical housing of these devices may be a light-weight plastic that offer protection and ventilation to components located inside. The housing of the wireless device may, however, be constructed of any material subject to the whims of the particular manufacturer.

FIG. 1 also illustrates a metallic shaping plate 120 coupled to the interior of the housing 130. In FIG. 1, the metallic shaping plate 120 is substantially centered with respect to the central, vertical axis of the horizontal antenna array 110. The static position of the metallic shaping plate 120 causes a change in the substantially omnidirectional radiation pattern generated by the horizontal antenna array 110.

The metallic shaping plate 120 effectuates such a change in the radiation pattern by 'flattening' the radiation pattern emitted by the antenna array 110. By flattening the pattern, the gain of the generated radiation pattern is increased. The tilt of the radiation pattern may also be influenced by, for example, the specific composition, thickness or shape of the plate 120. In FIG. 1, the plate 120 is substantially circular and uniform in thickness and manufacture. In other embodiments, the shape, thickness and material used in manufacture may differ throughout the plate.

In some embodiments, the metallic shaping plate 120 may be coupled to or operate in conjunction with a series of selectively coupled directors. The metallic shaping plate 120 and selectively coupled directors may be collectively configured to cause a change in the radiation pattern generated by the horizontal antenna array 110. The selective coupling of the directors may be similar to the coupling utilized with respect to directors located on the array 110.

The metallic shaping plate 120 may be coupled to the interior of the housing 130 using a permanent adhesive. In such an embodiment, removal of the plate 120—be it intentional or accidental—may require reapplication of an adhesive to the plate 120 and the housing 130 interior. The plate 120 may also be coupled using a reusable adhesive or other fastener (e.g., Velcro®) such that the plate 120 may be easily removed and reapplied.

Figure 2A:
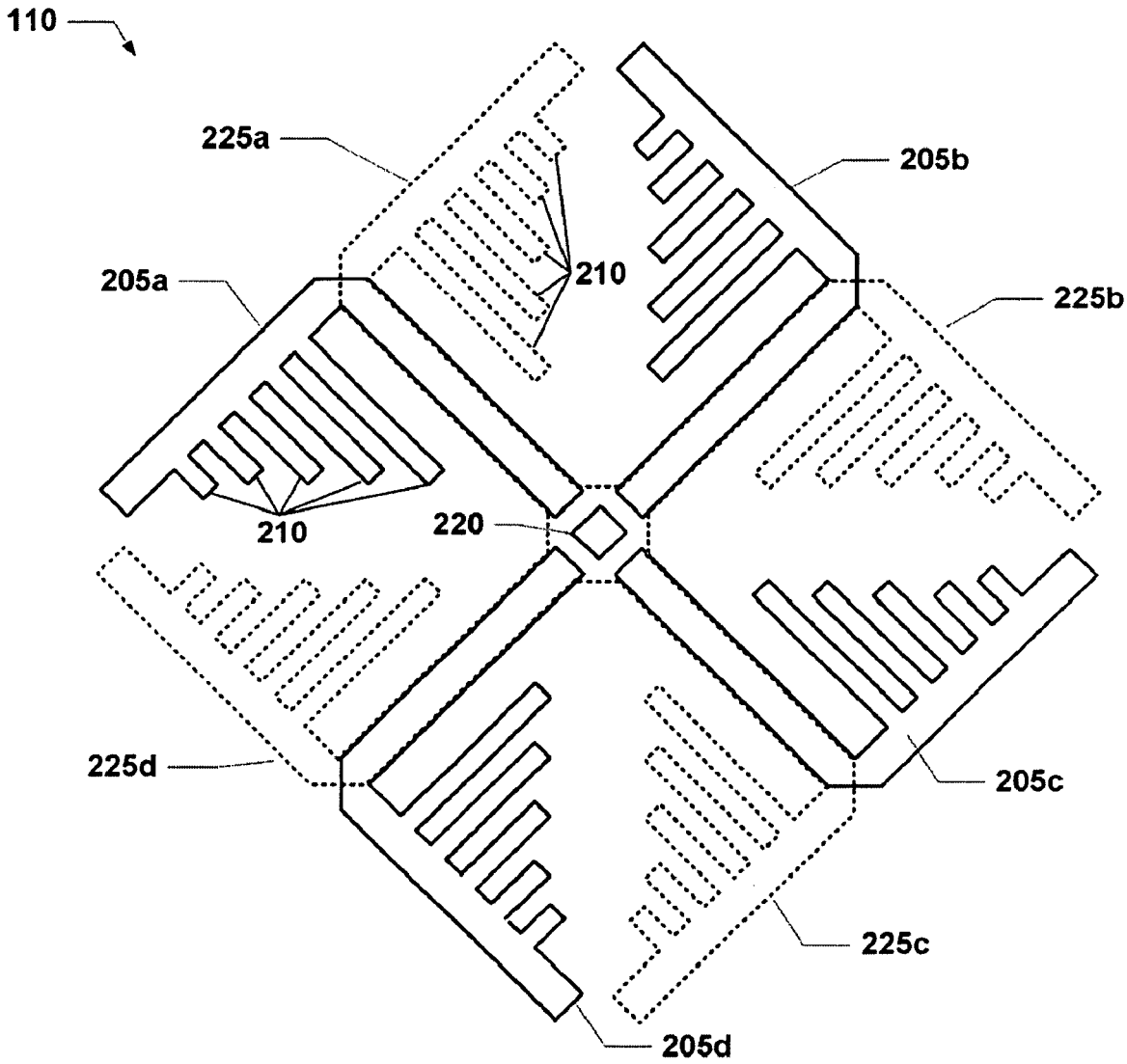
FIG. 2A illustrates a horizontally polarized antenna array with selectable elements as may be may be implemented in a wireless device like that described in FIG. 1.

FIG. 2A illustrates the antenna array 110 of FIG. 1 in one embodiment of the present invention. The antenna array 110 of this embodiment includes a substrate (considered as the plane of FIG. 2A) having a first side (depicted as solid lines 205) and a second side (depicted as dashed lines 225) substantially parallel to the first side. In some embodiments, the substrate includes a printed circuit board (PCB) such as FR4, Rogers 4003, or other dielectric material.

On the first side of the substrate, depicted by solid lines, the antenna array 110 of FIG. 2A includes a radio frequency feed port 220 and four antenna elements 205*a*-205*d*. Although four modified dipoles (i.e., antenna elements) are depicted, more or fewer antenna elements may be implemented. Although the antenna elements 205*a*-205*d* of FIG. 2A are oriented substantially to edges of a square shaped substrate so as to minimize the size of the antenna array 110, other configurations may be implemented. Further, although the antenna elements 205*a*-205*d* form a radially symmetrical layout about the radio frequency feed port 220, a number of non-symmetrical layouts, rectangular layouts, and layouts symmetrical in only one axis may be implemented. Furthermore, the antenna elements 205*a*-205*d* need not be of identical dimension, although depicted as such in FIG. 2A.

On the second side of the substrate, depicted as dashed lines in FIG. 2A, the antenna array 110 includes a ground component 225. It will be appreciated that a portion (e.g., the portion 225*a*) of the ground component 225 is configured to form a modified dipole in conjunction with the antenna element 205*a*. The dipole is completed for each of the antenna elements 205*a*-205*d* by respective conductive traces 225*a*-225*d* extending in mutually-opposite directions. The resultant modified dipole provides a horizontally polarized directional radiation pattern (i.e., substantially in the plane of the antenna array 110).

To minimize or reduce the size of the antenna array 110, each of the modified dipoles (e.g., the antenna element 205*a* and the portion 225*a* of the ground component 225) may incorporate one or more loading structures 210. For clarity of illustration, only the loading structures 210 for the modified dipole formed from the antenna element 205*a* and the portion 225*a* are numbered in FIG. 2A. The loading structure 210 is configured to slow down electrons, changing the resonance of each modified dipole, thereby making the modified dipole electrically shorter. At a given operating frequency, providing the loading structures 210 allows the dimension of the modified dipole to be reduced. Providing the loading structures 210 for all of the modified dipoles of the antenna array 110 minimizes the size of the antenna array 110.

Figure 2B:
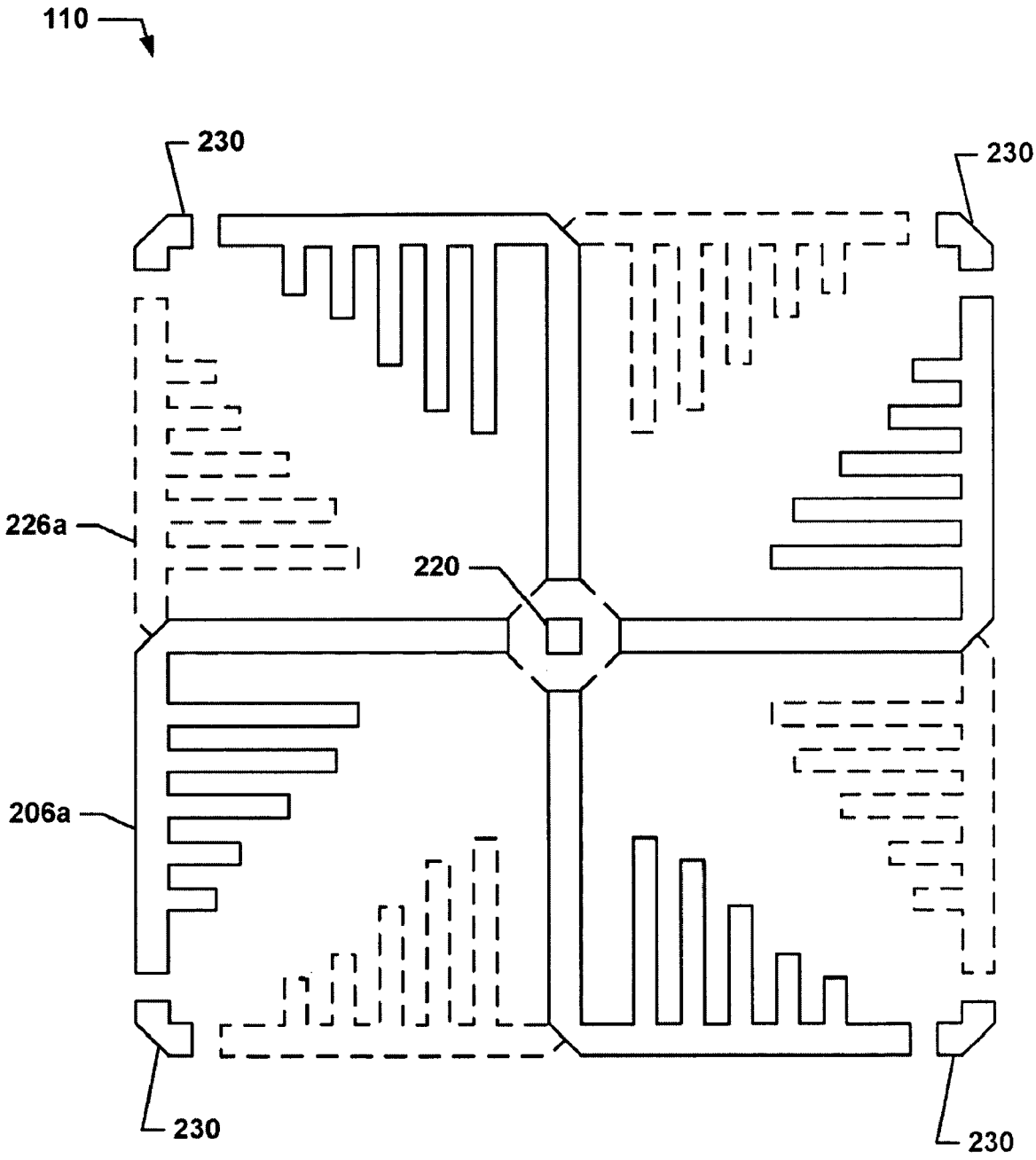
FIG. 2B illustrates an alternative embodiment of a horizontally polarized antenna array with selectable elements as may be implemented in a wireless device like that described in FIG. 1.

FIG. 2B illustrates an alternative embodiment of the antenna array 110 of FIG. 1. The antenna array 110 of this embodiment includes one or more directors 230. The directors 230 include passive elements that constrain the directional radiation pattern of the modified dipoles formed by antenna elements 206*a*-206*d* in conjunction with portions 226*a*-226*d* of the ground component (for clarity, only 206*a* and 226*a* labeled). Because of the directors 230, the antenna elements 206 and the portions 226 are slightly different in configuration than the antenna elements 205 and portions 225 of FIG. 2A. Directors 230 may be placed on either side of the substrate. Additional directors (not shown) may also be included to further constrain the directional radiation pattern of one or more of the modified dipoles.

The radio frequency feed port 220 of FIGS. 2A and 2B is configured to receive an RF signal from an RF generating device such as a radio. An antenna element selector (not shown) may be used to couple the radio frequency feed port 220 to one or more of the antenna elements 205. The antenna element selector may comprise an RF switch such as a PIN diode, a GaAs FET, or virtually any RF switching device.

An antenna element selector, as may be implemented in the context of FIG. 2A, may includes four PIN diodes, each PIN diode connecting one of the antenna elements 205*a*-205*d* to the radio frequency feed port 220. In such an embodiment, the PIN diode may include a single-pole single-throw switch to switch each antenna element either on or off (i.e., couple or decouple each of the antenna elements 205*a*-205*d* to the radio frequency feed port 220). A series of control signals may be used to bias each PIN diode. With the PIN diode forward biased and conducting a DC current, the PIN diode switch is on, and the corresponding antenna element is selected. With the diode reverse biased, the PIN diode switch is off.

In the case of FIG. 2A, the radio frequency feed port 220 and the PIN diodes of the antenna element selector may both be on the side of the substrate with the antenna elements 205*a*-205*d*. Other embodiments, however, may separate the radio frequency feed port 220, the antenna element selector, and the antenna elements 205*a*-205*d*. One or more light emitting diodes (not shown) may be coupled to the antenna element selector as a visual indicator of which of the antenna elements 205*a*-205*d* is on or off. A light emitting diode may be placed in circuit with the PIN diode so that the light emitting diode is lit when the corresponding antenna element 205 is selected.

The antenna components (e.g., the antenna elements 205*a*-205*d*, the ground component 225, and the directors 210) may be formed from RF conductive material. For example, the antenna elements 205*a*-205*d* and the ground component 225 may be formed from metal or other RF conducting material. Rather than being provided on opposing sides of the substrate as shown in FIGS. 2A and 2B, each antenna element 205*a*-205*d* is coplanar with the ground component 225.

The antenna components may also be conformally mounted to the housing of the system 100. In such embodiments, the antenna element selector may comprise a separate structure (not shown) from the antenna elements 205*a*-205*d*. The antenna element selector may be mounted on a relatively small PCB and the PCB may be electrically coupled to the antenna elements 205*a*-205*d*. In some embodiments, the switch PCB is soldered directly to the antenna elements 205*a*-205*d*.

Figure 3:
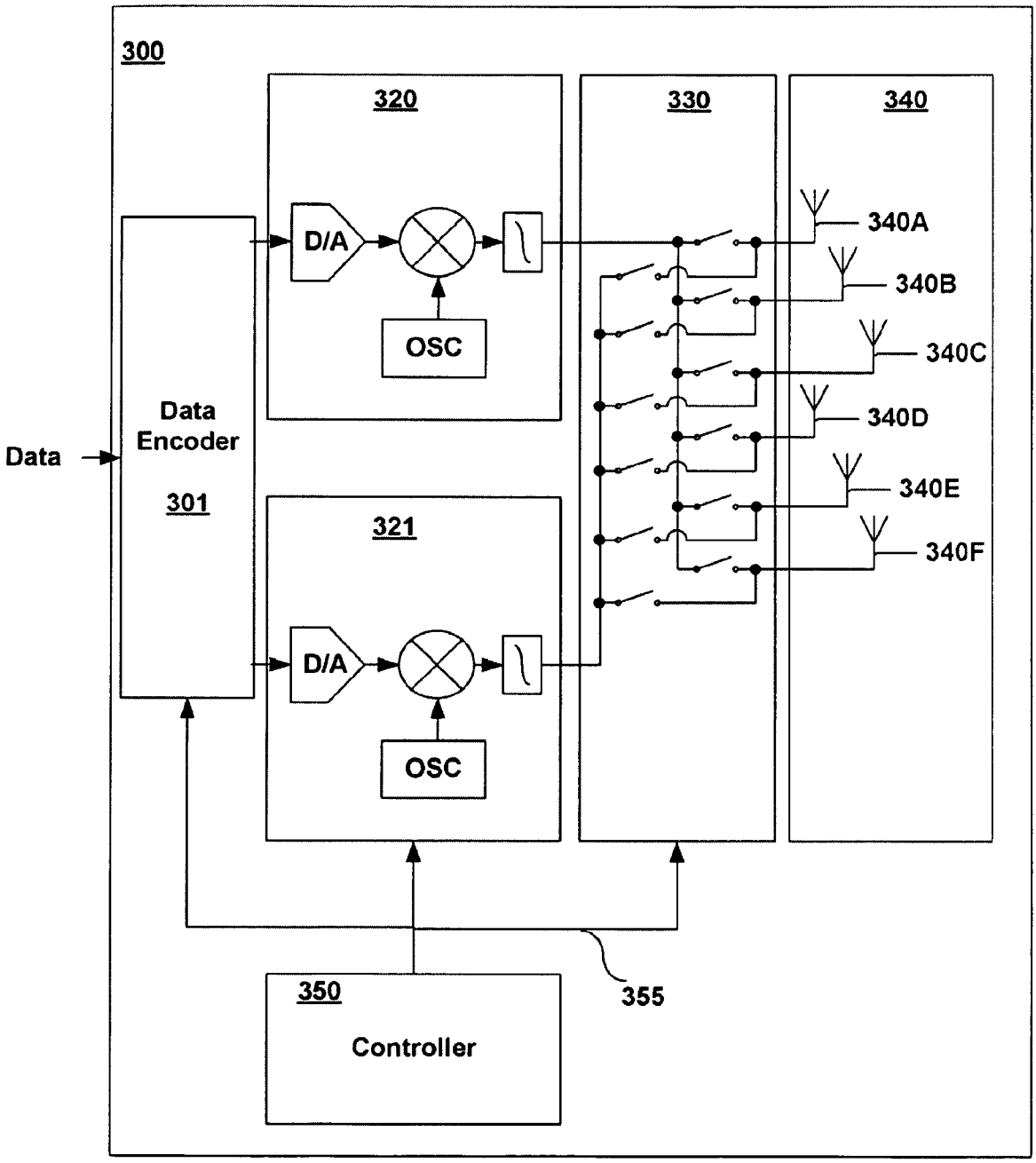
FIG. 3 illustrates a wireless multiple-input-multiple-output (MIMO) antenna system having multiple antennas and multiple radios as may be implemented in a wireless device like that described in FIG. 1.

FIG. 3 illustrates a wireless MIMO antenna system having multiple antennas and multiple radios. A MIMO antenna system may be used as (or part of) the horizontal array 110 of FIG. 1. The wireless MIMO antenna system 300 illustrated in FIG. 3 may be representative of a transmitter and/or a receiver such as an 802.11 access point or an 802.11 receiver. System 300 may also be representative of a set-top box, a laptop computer, television, Personal Computer Memory Card International Association (PCMCIA) card, Voice over Internet Protocol (VoIP) telephone, or handheld gaming device.

Wireless MIMO antenna system 300 may include a communication device for generating a radio frequency signal (e.g., in the case of transmitting node). Wireless MIMO antenna system 300 may also or alternatively receive data from a router connected to the Internet. Wireless MIMO antenna system 300 may then transmit that data to one or more of the remote receiving nodes. For example, the data may be video data transmitted to a set-top box for display on a television or video display.

The wireless MIMO antenna system 300 may form a part of a wireless local area network (e.g., a mesh network) by enabling communications among several transmission and/or receiving nodes. Although generally described as transmitting to a remote receiving node, the wireless MIMO antenna system 300 of FIG. 3 may also receive data subject to the presence of appropriate circuitry. Such circuitry may include but is not limited to a decoder, downconversion circuitry, samplers, digital-to-analog converters, filters, and so forth.

Wireless MIMO antenna system 300 includes a data encoder 301 for encoding data into a format appropriate for transmission to the remote receiving node via parallel radios 320 and 321. While two radios are illustrated in FIG. 3, additional radios or RF chains may be utilized. Data encoder 301 may include data encoding elements such as direct sequence spread-spectrum (DSSS) or Orthogonal Frequency Division Multiplex (OFDM) encoding mechanisms to generate baseband data streams in an appropriate format. Data encoder 301 may include hardware and/or software elements for converting data received into the wireless MIMO antenna system 300 into data packets compliant with the IEEE 802.11 format.

Radios 320 and 321 include transmitter or transceiver elements configured to upconvert the baseband data streams from the data encoder 301 to radio signals. Radios 320 and 321 thereby establish and maintain the wireless link. Radios 320 and 321 may include direct-to-RF upconverters or heterodyne upconverters for generating a first RF signal and a second RF signal, respectively. Generally, the first and second RF signals are at the same center frequency and bandwidth but may be offset in time or otherwise space-time coded.

Wireless MIMO antenna system 300 further includes a circuit (e.g., switching network) 330 for selectively coupling the first and second RF signals from the parallel radios 320 and 321 to an antenna apparatus 340 having multiple antenna elements 340A-F. Antenna elements 340A-F may include individually selectable antenna elements such that each antenna element 340A-F may be electrically selected (e.g., switched on or off). By selecting various combinations of the antenna elements 340A-F, the antenna apparatus 340 may form a "pattern agile" or reconfigurable radiation pattern. If certain or substantially all of the antenna elements 340A-F are switched on, for example, the antenna apparatus 340 may form an omnidirectional radiation pattern. Through the use of MIMO antenna architecture, the pattern may include both vertically and horizontally polarized energy, which may also be referred to as diagonally polarized radiation. Alternatively, the antenna apparatus 340 may form various directional radiation patterns, depending upon which of the antenna elements 340A-F are turned on.

Wireless MIMO antenna system 300 may also include a controller 350 coupled to the data encoder 301, the radios 320 and 321, and the circuit 330 via a control bus 355. The controller 350 may include hardware (e.g., a microprocessor and logic) and/or software elements to control the operation of the wireless MIMO antenna system 300.

The controller 350 may select a particular configuration of antenna elements 340A-F that minimizes interference over the wireless link to the remote receiving device. If the wireless link experiences interference, for example due to other radio transmitting devices, or changes or disturbances in the wireless link between the wireless MIMO antenna system 300 and the remote receiving device, the controller 350 may select a different configuration of selected antenna elements 340A-F via the circuit 330 to change the resulting radiation pattern and minimize the interference. For example, the controller 350 may select a configuration of selected antenna elements 340A-F corresponding to a maximum gain between the wireless system 300 and the remote receiving device. Alternatively, the controller 350 may select a configuration of selected antenna elements 340A-F corresponding to less than maximal gain, but corresponding to reduced interference in the wireless link.

Controller 350 may also transmit a data packet using a first subgroup of antenna elements 340A-F coupled to the radio 320 and simultaneously send the data packet using a second group of antenna elements 340A-F coupled to the radio 321. Controller 350 may change the group of antenna elements 340A-F coupled to the radios 320 and 321 on a packet-by-packet basis. Methods performed by the controller 350 with respect to a single radio having access to multiple antenna elements are further described in U.S. patent publication number US 2006-0040707 A1. These methods are also applicable to the controller 350 having control over multiple antenna elements and multiple radios.

A MIMO antenna apparatus may include a number of modified slot antennas and/or modified dipoles configured to transmit and/or receive horizontal polarization. The MIMO antenna apparatus may further include a number of modified dipoles to provide vertical polarization. Examples of such antennas include those disclosed in U.S. patent application Ser. No. 11/413,461. Each dipole and each slot provides gain (with respect to isotropic) and a polarized directional radiation pattern. The slots and the dipoles may be arranged with respect to each other to provide offset radiation patterns.

For example, if two or more of the dipoles are switched on, the antenna apparatus may form a substantially omnidirectional radiation pattern with vertical polarization. Similarly, if two or more of the slots are switched on, the antenna apparatus may form a substantially omnidirectional radiation pattern with horizontal polarization. Diagonally polarized radiation patterns may also be generated.

The antenna apparatus may easily be manufactured from common planar substrates such as an FR4 PCB. The PCB may be partitioned into portions including one or more elements of the antenna apparatus, which portions may then be arranged and coupled (e.g., by soldering) to form a non-planar antenna apparatus having a number of antenna elements. In some embodiments, the slots may be integrated into or conformably mounted to a housing of the system, to minimize cost and size of the system, and to provide support for the antenna apparatus.

Figure 4A:
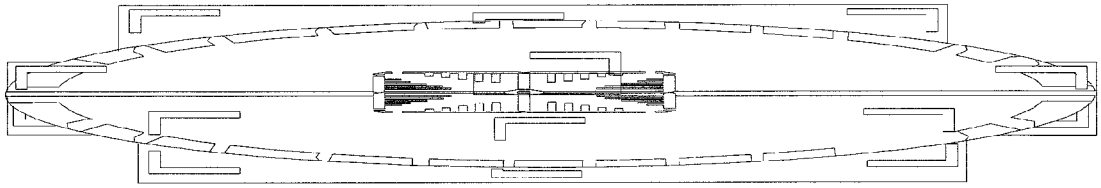
FIG. 4A illustrates a horizontally narrow embodiment of a MIMO antenna apparatus as may be implemented in a wireless device like that described in FIG. 1.
Figure 4B:
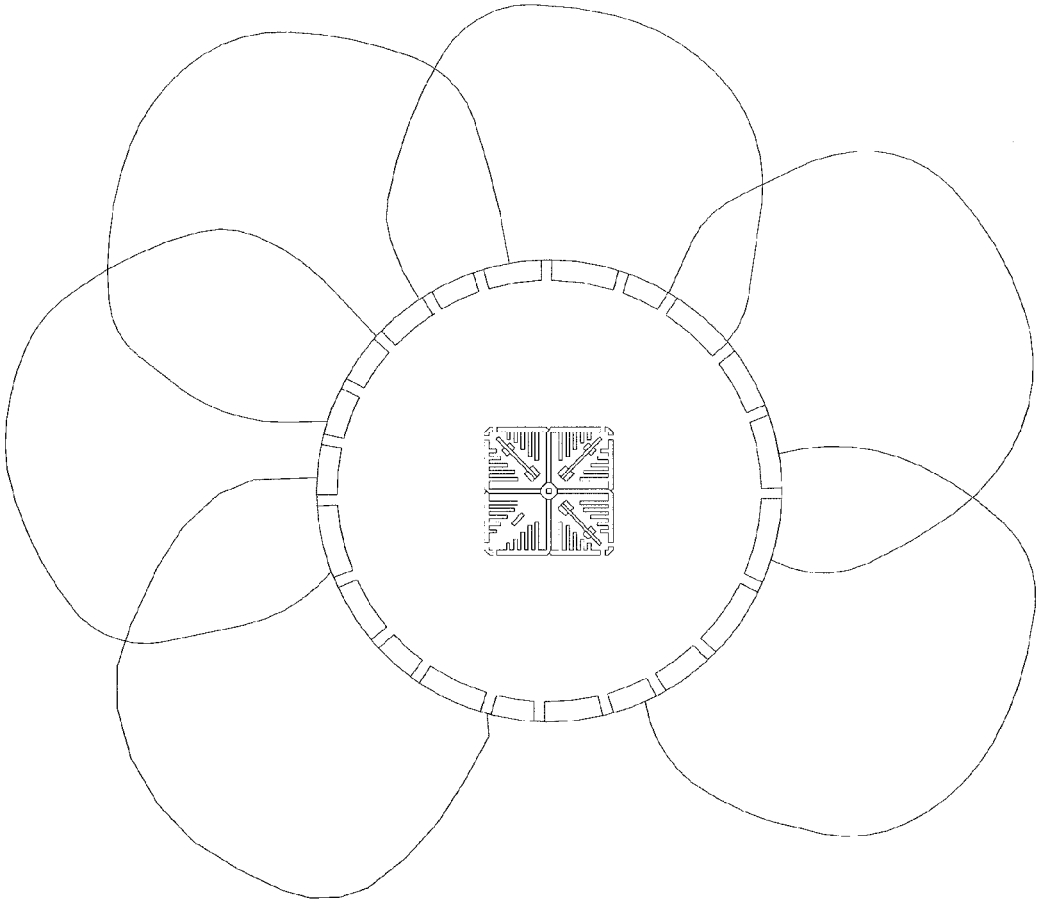
FIG. 4B illustrates a corresponding radiation pattern as may be generated by the embodiment illustrated in FIG. 4A.

FIG. 4A illustrates a horizontally narrow embodiment of a MIMO antenna apparatus (as generally described in FIG. 3) and as may be implemented in a wireless device like that described in FIG. 1. FIG. 4B illustrates a corresponding radiation pattern as may be generated by the embodiment illustrated in FIG. 4A. In the embodiment illustrated in FIG. 4A, horizontally polarized parasitic elements may be positioned about a central omnidirectional antenna. All elements (i.e., the parasitic elements and central omni) may be etched on the same PCB to simplify manufacturability. Switching elements may change the length of parasitic thereby making them transparent to radiation. Alternatively, switching elements may cause the parasitic elements to reflect energy back towards the driven dipole resulting in higher gain in that direction. An opposite parasitic element may be configured to function as a direction to increase gain. Other details as to the manufacture and construction of a horizontally narrow MIMO antenna apparatus may be found in U.S. patent application Ser. No. 11/041,145.

Figure 5:
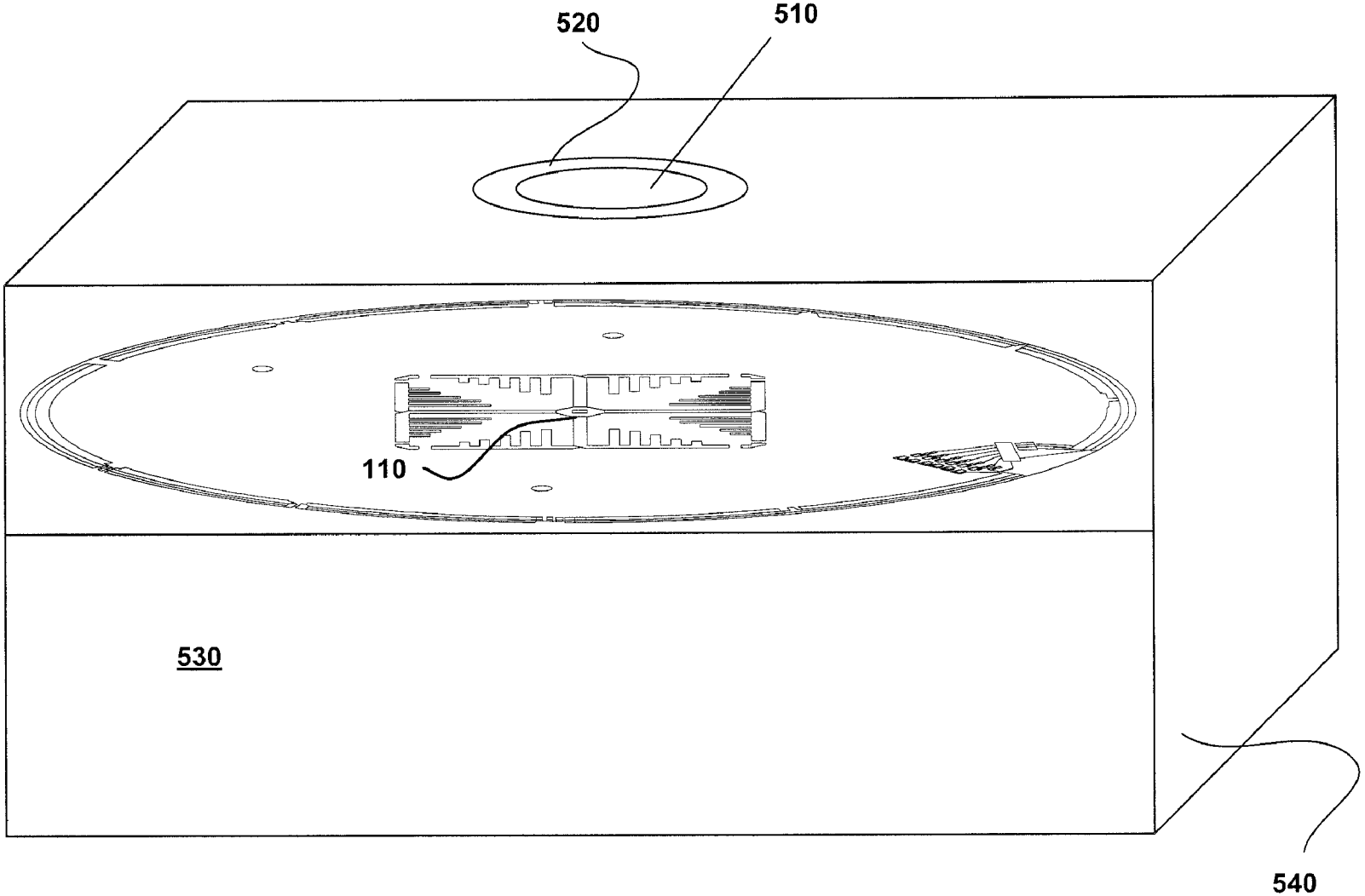
FIG. 5 illustrates an alternative embodiment of FIG. 1, wherein the metallic shaping plate is a metallic ring situated in a plastic or other non-metallic enclosure.

FIG. 5 illustrates an alternative embodiment of FIG. 1. In the embodiment of FIG. 5, the metallic shaping plate 510 is situated in a plastic enclosure 520. The plastic enclosure may fully encapsulate the metallic shaping plate 510 such that no portion of the plate is directly exposed to the interior environment 530 of the wireless device 540.

Alternatively, the plastic may encase only the edges of the metallic shaping plate 510. In such an implementation, at least a portion of the metallic shaping plate 510 is directly exposed to the interior environment of the wireless device 540. By encasing only the edges of the shaping plate 510, the metallic shaping plate 410 may be more easily removed from the casing 520 and replaced in the wireless device 540. Removal and replacement of the metallic shaping plate 510 may allow for different shaping plates with different shaping properties to be used in a single wireless device 540. As such, the wireless device 540 may be implemented in various and changing wireless environments. The casing, in such an embodiment, may be permanently adhered to the interior of the device 540 housing although temporary adhesives may also be utilized.

In some embodiments, a series of metallic shaping plates may be utilized. One plate of particular configuration (e.g., shape, size, thickness, material) may be positioned on top of another shaping plate of a different configuration. In yet another embodiment, a series of rings may surround a single metallic shaping plate. The plate in such an embodiment may have one configuration and each of the surrounding rings may represent a different configuration each with their own shaping properties.

Multiple plates may also be used, each with their own shaping properties. Plates may be located on the interior top and bottom of a housing apparatus, along the sides, or at any other point or points therein. In such an embodiment, the positioning of the plates need not necessarily be centered with respect to an antenna array.

Figure 6:
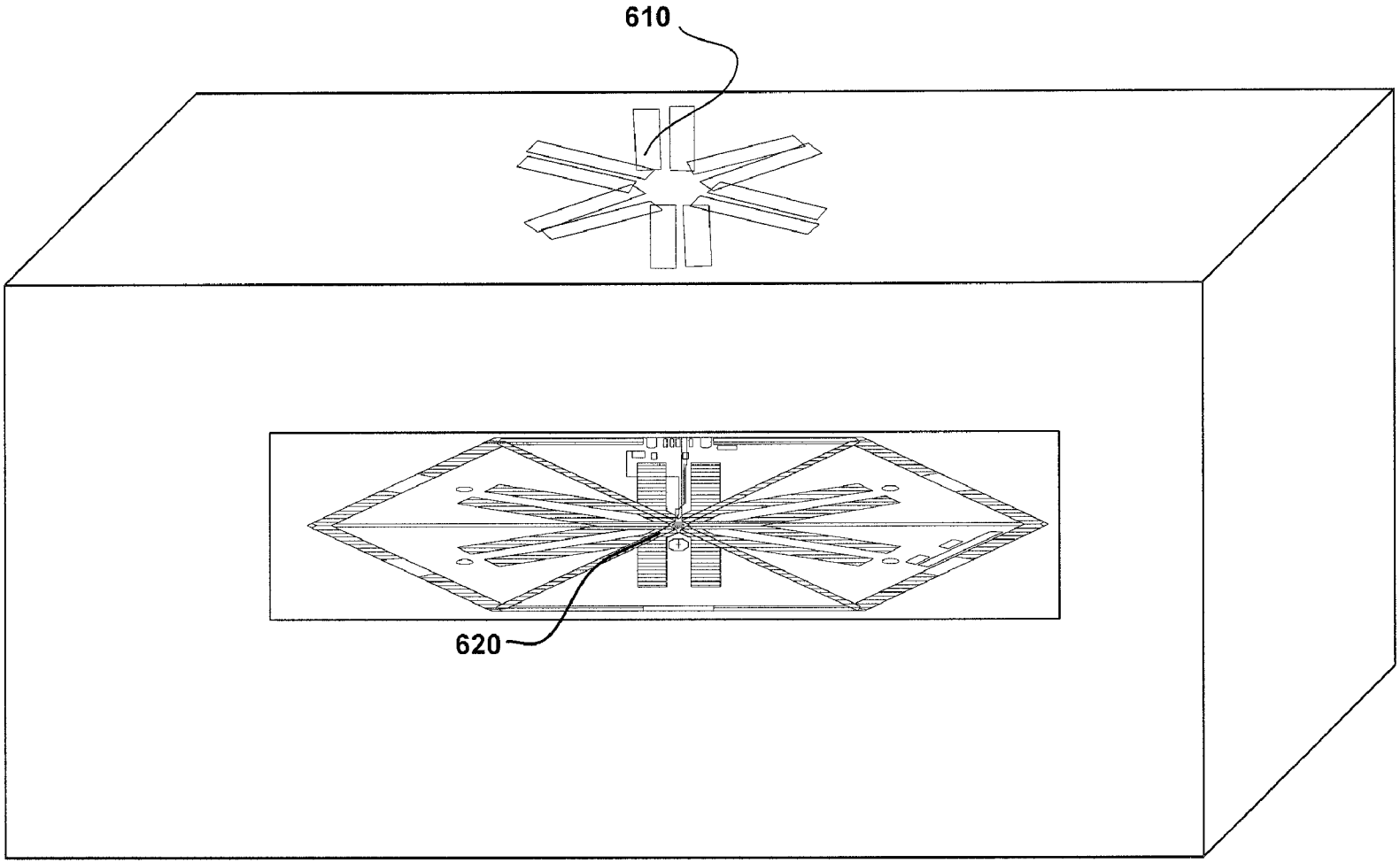
FIG. 6 illustrates a further embodiment of the present invention wherein the metallic shaping plate corresponds, in part, to the element layout design of the antenna array.

FIG. 6 illustrates a further embodiment of the present invention wherein the metallic shaping plate 610 corresponds, in part, to the element layout design of the antenna array 620. The shaping plate, in such an embodiment, may correspond to any particular shape and/or configuration. Various portions of the shaping plate may be made of different materials, be of different thicknesses, and/or be located in various locales of the housing with respect to various elements of the antenna array. Various encasings may be utilized as described in the context of FIG. 5. Other plates may be used in conjunction with the plate of FIG. 6; said plates need not correspond to the shape of the array.

The embodiments disclosed herein are illustrative. Various modifications or adaptations of the structures and methods described herein may become apparent to those skilled in the art. Such modifications, adaptations, and/or variations that rely upon the teachings of the present disclosure and through which these teachings have advanced the art are considered to be within the spirit and scope of the present invention. Hence, the descriptions and drawings herein should be limited by reference to the specific limitations set forth in the claims appended hereto.

What is claimed is:

1. A wireless device, comprising:

a horizontal antenna array comprising a plurality of antenna elements, wherein two or more of the plurality of antenna elements are selectively coupled to a radio frequency feed port to generate a substantially omnidirectional radiation pattern having less directionality than the directional radiation pattern of a single antenna element, the substantially omnidirectional radiation pattern being substantially in the plane of the horizontal antenna array;

a housing enclosing the horizontal antenna array;

at least one metallic shaping plate, the metallic shaping plate coupled to the interior of the housing and substantially centered with respect to the central, vertical axis of the horizontal antenna array, the placement of the at least one metallic shaping plate causing a change in the substantially omnidirectional radiation pattern generated by the horizontal antenna array.

2. The wireless device of claim 1, wherein the change in the substantially omnidirectional radiation pattern caused by the metallic shaping plate is a flattening of the pattern, thereby increasing the gain of the radiation pattern generated by the horizontal antenna array.

3. The wireless device of claim 1, wherein the metallic shaping plate is substantially circular.

4. The wireless device of claim 1, wherein the change in the change in the substantially omnidirectional radiation pattern caused by the metallic plate comprises a change in the tilt of the radiation pattern generated by the horizontal array.

5. The wireless device of claim 1, wherein the horizontal antenna array comprises a plurality of selectively coupled directors configured to cause a change in the substantially omnidirectional radiation pattern generated by the horizontal antenna array.

6. The wireless device of claim 1, wherein the metallic shaping plate is coupled to a plurality of selectively coupled directors, such that the metallic shaping plate and the plurality of selectively coupled directors are collectively configured to cause a change in the substantially omnidirectional radiation pattern generated by the horizontal antenna array.

7. The wireless device of claim 1, wherein the metallic shaping plate is coupled to the interior of the housing via an intermediate plastic casing encapsulating the metallic shaping plate.

8. The wireless device of claim 1, wherein the metallic shaping plate is coupled to the interior of the housing via a permanent adhesive.

9. The wireless device of claim 1, wherein the metallic shaping plate is coupled to the interior of the housing via a reusable adhesive.

10. The wireless device of claim 1, wherein the metallic shaping plate corresponds in part to the layout design of one or more of the plurality of antenna elements of the horizontal antenna array.

11. The wireless device of claim 1, wherein the metallic shaping plate is surrounded by at least one metallic shaping ring, wherein the metallic shaping plate and the at least one metallic shaping ring are collectively configured to cause a change in the substantially omnidirectional radiation pattern generated by the horizontal antenna array.

12. A metallic shaping plate configured to be coupled to the interior of a housing for a horizontal antenna array, the shaping plate further configured to be substantially centered with respect to the central, vertical axis of the horizontal antenna array, wherein the placement of the shaping plate causes a change in a radiation pattern generated by the horizontal antenna array.

* * * * *